US008194031B2

(12) United States Patent
Yao et al.

(10) Patent No.: US 8,194,031 B2
(45) Date of Patent: Jun. 5, 2012

(54) BACKLIGHT CONTROL OF ELECTRONIC DEVICE

(75) Inventors: Wei Yao, Fremont, CA (US); Wei Chen, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/909,536

(22) Filed: Oct. 21, 2010

(65) Prior Publication Data

US 2011/0032285 A1 Feb. 10, 2011

Related U.S. Application Data

(63) Continuation of application No. 11/446,469, filed on Jun. 2, 2006, now Pat. No. 7,825,891.

(51) Int. Cl.
*G09G 3/36* (2006.01)

(52) U.S. Cl. ..... 345/102; 345/87; 345/204; 345/211; 345/212

(58) Field of Classification Search ..... 345/55, 345/84, 87, 102, 104, 204, 211, 212
See application file for complete search history.

(56) References Cited

U.S. PATENT DOCUMENTS

| | | | | |
|---|---|---|---|---|
| 5,915,120 | A | 6/1999 | Wada et al. | |
| 6,388,388 | B1 | 5/2002 | Weindorf et al. | |
| 6,762,741 | B2 | 7/2004 | Weindorf | |
| 6,841,947 | B2 * | 1/2005 | Berg-johansen | 315/169.3 |
| 7,609,360 | B2 * | 10/2009 | Yamaguchi | 349/199 |
| 7,843,422 | B1 * | 11/2010 | Ludden et al. | 345/102 |
| 2005/0134547 | A1 | 6/2005 | Wyatt | |
| 2006/0132424 | A1 | 6/2006 | Foo et al. | |
| 2006/0197735 | A1 | 9/2006 | Vuong et al. | |

* cited by examiner

*Primary Examiner* — My-Chau T Tran
(74) *Attorney, Agent, or Firm* — Beyer Law Group LLP

(57) ABSTRACT

Embodiments are provided herein which may be utilized to eliminate stray light emissions from an LED while ambient light is being sensed. As such, dynamic backlight control systems for use with an electronic display are presented including: an ambient light sensor for sensing ambient light intensity; a backlight for illuminating the electronic display; a switch for controlling the backlight, the switch configured to set a backlight condition to ON or OFF in response to a backlight-off frequency such that the ambient light sensor senses the ambient light intensity in the absence of the backlight; a logic module for determining a backlight level in response to the ambient light intensity; and a backlight control circuit for adjusting the backlight to the backlight level in response to the ambient light intensity.

19 Claims, 5 Drawing Sheets

BACKLIGHT CONTROL OF ELECTRONIC DEVICE

CROSS REFERENCE TO RELATED APPLICATION

This application claims priority to co-pending and commonly owned U.S. patent application Ser. No. 11/446,469, filed Jun. 2, 2006, and entitled "DYNAMIC BACKLIGHT CONTROL SYSTEM," which is incorporated by reference herein in its entirety and for all purposes.

BACKGROUND

Portable electronic devices permeate everyday life in modern technological society. From portable information management systems to portable entertainment systems, the demand for new devices having more robust features and reliability continues to grow. One area that is critical to the success of an innovative electronic device is electronic display configuration and management. As may be appreciated, electronic displays utilized in portable electronic devices may be subject to a variety of environmental factors such as ambient light extremes, which may adversely affect a user's viewing experience. For example, when an electronic device is carried from indoors to direct sunlight, the devices electronic display may be too dark to read until the display compensates for the ambient light change. Conversely, when an electronic device is carried from direct sunlight to indoors, the device's electronic display may be too bright to view until the display compensates for the ambient light change.

To address this problem, some electronic devices utilize an ambient light sensor in combination with an electronic display. The purpose of an ambient light sensor is to sense ambient light intensity. Sensed ambient light intensity generates data that may then be used to adjust electronic display brightness. FIG. 1 is a graphical representation of a prior art backlight control curve graph. As may be appreciated, backlight control may be utilized with an electronic display to adjust backlight levels (i.e. brightness). As illustrated, a backlight control curve is graphed with respect to backlight level 110 and ambient light intensity 120. In this example, a minimum backlight start level 102 may be utilized for a low ambient light intensity. Point 104 represents a stepped increase in backlight level over a range of ambient light intensity. Point 106 represents a maximum backlight level available for a particular ambient light level. Point 108 represents a point at which ambient light intensity is high enough that the electronic display no longer benefits from backlight, at which point backlight level is reduced to zero (i.e. backlight is switched to OFF). As may be appreciated, a stepped increase in backlight level may provide at least some response to changing ambient light conditions. However, this technique represents a compromise. That is, the coarse granularity in backlight control often results in a backlight level that is too high or too low for a given ambient light condition. A finer granularity of backlight control may provide backlight levels that more closely match an ambient light condition and thus, may enhance a user's viewing experience.

In some conventional electronic devices, an ambient light sensor may be isolated from the devices electronic display in order to avoid stray light emissions from the display. However, in other electronic devices, an ambient light sensor may be co-located with the device's electronic display in order to achieve, for example, a smaller form factor. In those examples, light emissions from the electronic display may interfere with the ambient light sensor. Thus, for example, ambient light intensity may be incorrectly read as too high because of contributing stray light emissions from the electronic display resulting in an inaccurate backlight level. As such, it may be advantageous to eliminate stray light emissions while an ambient light sensor is operating.

Therefore, dynamic backlight control systems are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

Embodiments are provided herein which may be utilized to eliminate stray light emissions from an LED while ambient light is being sensed. As such, dynamic backlight control systems for use with an electronic display are presented including: an ambient light sensor for sensing ambient light intensity; a backlight for illuminating the electronic display; a switch for controlling the backlight, the switch configured to set a backlight condition to ON or OFF in response to a backlight-off frequency such that the ambient light sensor senses the ambient light intensity in the absence of the backlight; a logic module for determining a backlight level in response to the ambient light intensity; and a backlight control circuit for adjusting the backlight to the backlight level in response to the ambient light intensity. In some embodiments, systems further include: an analog-to-digital circuit for converting the ambient light intensity into ambient light intensity data; and a data bus configured to send the backlight level to a processor. In some embodiments, systems further include: logic for determining a periodicity of the electronic display; logic for determining the backlight-off frequency at a non-integer ratio with respect to the periodicity of the electronic display; logic for controlling the switch in accordance with the backlight-off frequency wherein flicker is substantially avoided.

In other embodiments, integrated circuits for controlling a backlight, the backlight for use with an electronic display are presented including: a switch for controlling the backlight, the switch configured to set a backlight condition to ON or OFF such that an ambient light sensor senses an ambient light intensity in the absence of the backlight; an analog-to-digital circuit for converting the ambient light intensity into ambient light intensity data; a logic module for determining a backlight level in response to the ambient light intensity; a timer for providing a timing element for the logic module; and a backlight control circuit for adjusting the backlight to the backlight level in response to the ambient light intensity. In some embodiments, integrated circuits further include: a data bus configured to send the backlight level to a processor. In some embodiments, the logic module further includes: logic for determining a periodicity of the electronic display; logic for determining a backlight-off frequency at a non-integer ratio with respect to the periodicity of the electronic display; logic for controlling the switch in accordance with the frequency wherein flicker is substantially avoided.

In other embodiments, methods of dynamically controlling a backlight for use with an electronic display are presented including the steps of: determining a periodicity of the electronic display; determining a backlight-off frequency corresponding to the periodicity of the electronic display, the backlight-off frequency limited to a non-integer ratio of the periodicity of the electronic display; for each backlight-off frequency, turning off the backlight, and sampling an ambient light intensity; and adjusting the backlight to a backlight level in response to the ambient light intensity. In some embodiments, methods further include converting the ambient light intensity to an ambient light intensity data, the ambient light intensity data configured as a digital signal. In some embodiments, methods further include: sending the backlight level to a processor; and updating a power consumption level based on at least the backlight level. In some embodiments, methods further include: if the ambient light intensity exceeds a maximum threshold over a threshold time interval, turning off the backlight.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Various embodiments are described herein below, including methods and techniques. It should be kept in mind that the invention might also cover articles of manufacture that includes a computer readable medium on which computer-readable instructions for carrying out embodiments of the inventive technique are stored. The computer readable medium may include, for example, semiconductor, magnetic, optomagnetic, optical, or other forms of computer readable medium for storing computer readable code. Further, the invention may also cover apparatuses for practicing embodiments of the invention. Such apparatus may include circuits, dedicated and/or programmable, to carry out tasks pertaining to embodiments of the invention. Examples of such apparatus include a general-purpose computer and/or a dedicated computing device when appropriately programmed and may include a combination of a computer/computing device and dedicated/programmable circuits adapted for the various tasks pertaining to embodiments of the invention.

Figure 1:
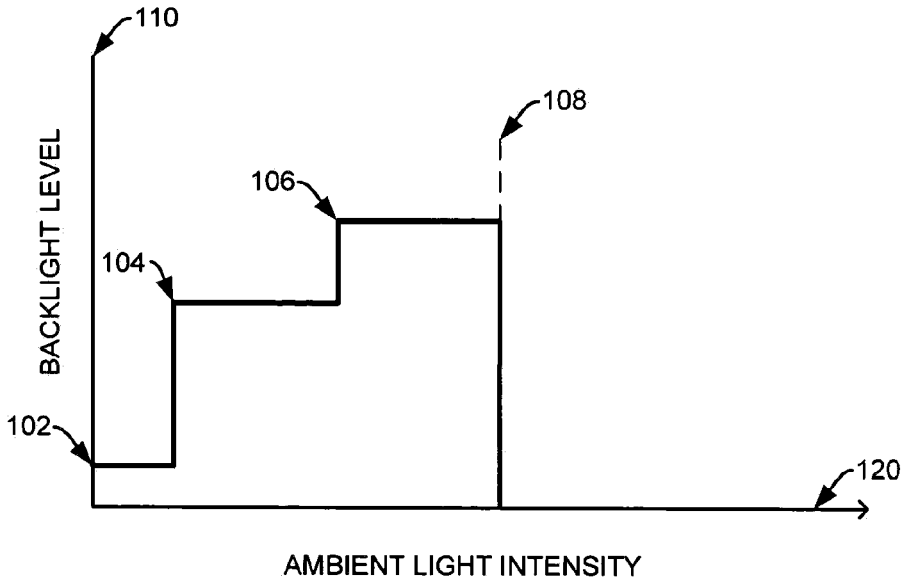
PRIOR ART FIG. 1
FIG. 1 is a graphical representation of a prior art backlight control curve graph.
Figure 2:
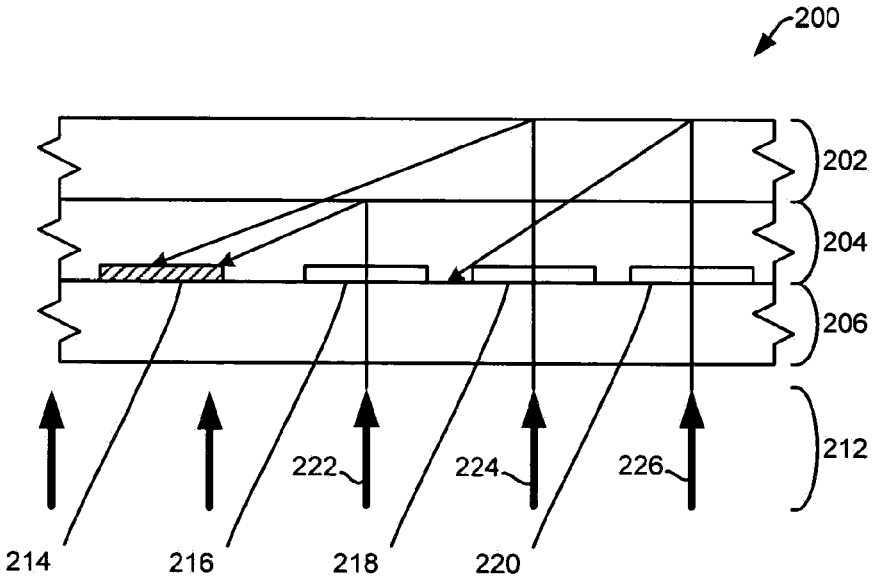
FIG. 2 is an illustrative cross-section of a portion of an electronic display including stray emissions from a backlight.

FIG. 2 is an illustrative cross-section of a portion of an electronic display including stray reflections from a backlight. In this example, an LCD 200 is illustrated. However, embodiments provided herein may be equally applied to LED and OLED's without departing from the present invention. Thus, LCD 200 is illustrated having a color filter (CF) glass layer 202, a liquid crystal layer 204, and an array glass layer 206. LCD 200 further includes pixels 216, 218, and 220, which may be mounted on array glass layer 206. An ambient light sensor 214 is also mounted on array glass layer 206. As is well-known in the art, a backlight 212 may be utilized with an LCD to provide illumination of pixels. In some instances, some portion of a backlight may interfere with a mounted ambient light sensor by reflecting at any of a number of interfaces between layers. Thus, backlight portion 222 may reflect at an interface between liquid crystal layer 204 and CF glass layer 202. This reflection may be sensed by ambient light sensor 214 resulting in an erroneous reading. Further, backlight portion 224 may reflect at an interface of CF glass layer 202. This reflection may be sensed by ambient light sensor 214 resulting in an erroneous reading. It may be noted that in some instances, a backlight portion may reflect harmlessly. For example, backlight portion 226 may reflect at an interface of CF glass layer 202. This reflection, however, may not be sensed by ambient light sensor 214 as illustrated.

Figure 3:
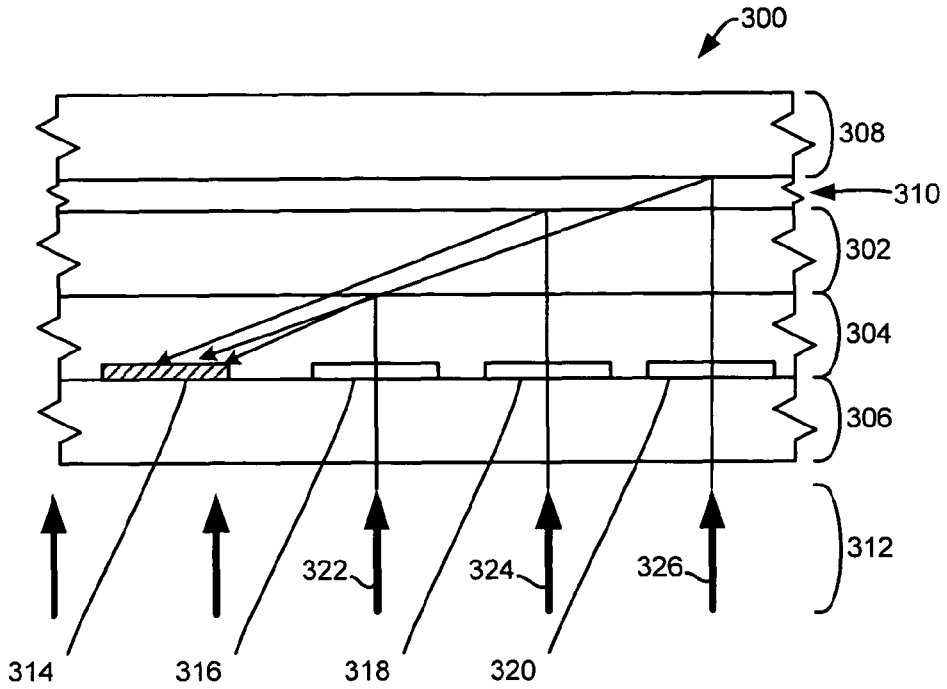
FIG. 3 is an illustrative cross-section of a portion of an electronic display with a cover including stray emissions from a backlight.

FIG. 3 is an illustrative cross-section of a portion of an electronic display with a cover having stray reflections from a backlight. In this example, an LCD 300 is illustrated. However, embodiments provided herein may be equally applied to LED and OLED's without departing from the present invention. Thus, LCD 300 is illustrated having a cover glass layer 308, a pressure sensitive adhesive (PSA) or space layer 310, a CF glass layer 302, a liquid crystal layer 304, and an array glass layer 306. LCD 300 further includes pixels 316, 318, and 320, which may be mounted on array glass layer 306. An ambient light sensor 314 is also mounted on array glass layer 306. As is well-known in the art, a backlight 312 may be utilized with an LCD to provide illumination of pixels. As noted above, in some instances, some portion of a backlight may interfere with a mounted ambient light sensor by reflecting at any of a number of interfaces between layers. Thus, backlight portion 322 may reflect at an interface between liquid crystal layer 304 and CF glass layer 302. This reflection may be sensed by ambient light sensor 314 resulting in an erroneous reading. Further, backlight portion 324 may reflect at an interface of CF glass layer 302. This reflection may be sensed by ambient light sensor 314 resulting in an erroneous reading. Still further, where additional layers are present, backlight portion 326 may reflect at an interface of PSA layer 310 and cover glass layer 308. This reflection may be sensed by ambient light sensor 314 resulting in an erroneous reading.

As may be appreciated, in the above examples, for any number of layers on an LCD display, there may result stray light emissions due to reflectivity between layers. Because reflectivity may not be constant across an LCD, accounting for the effect of the stray light emissions through an algorithm may prove difficult to impossible. Furthermore, because of the proximity of an ambient light sensor to a pixel in an LCD display, physical isolation of the sensor may not be possible.

Figure 5:
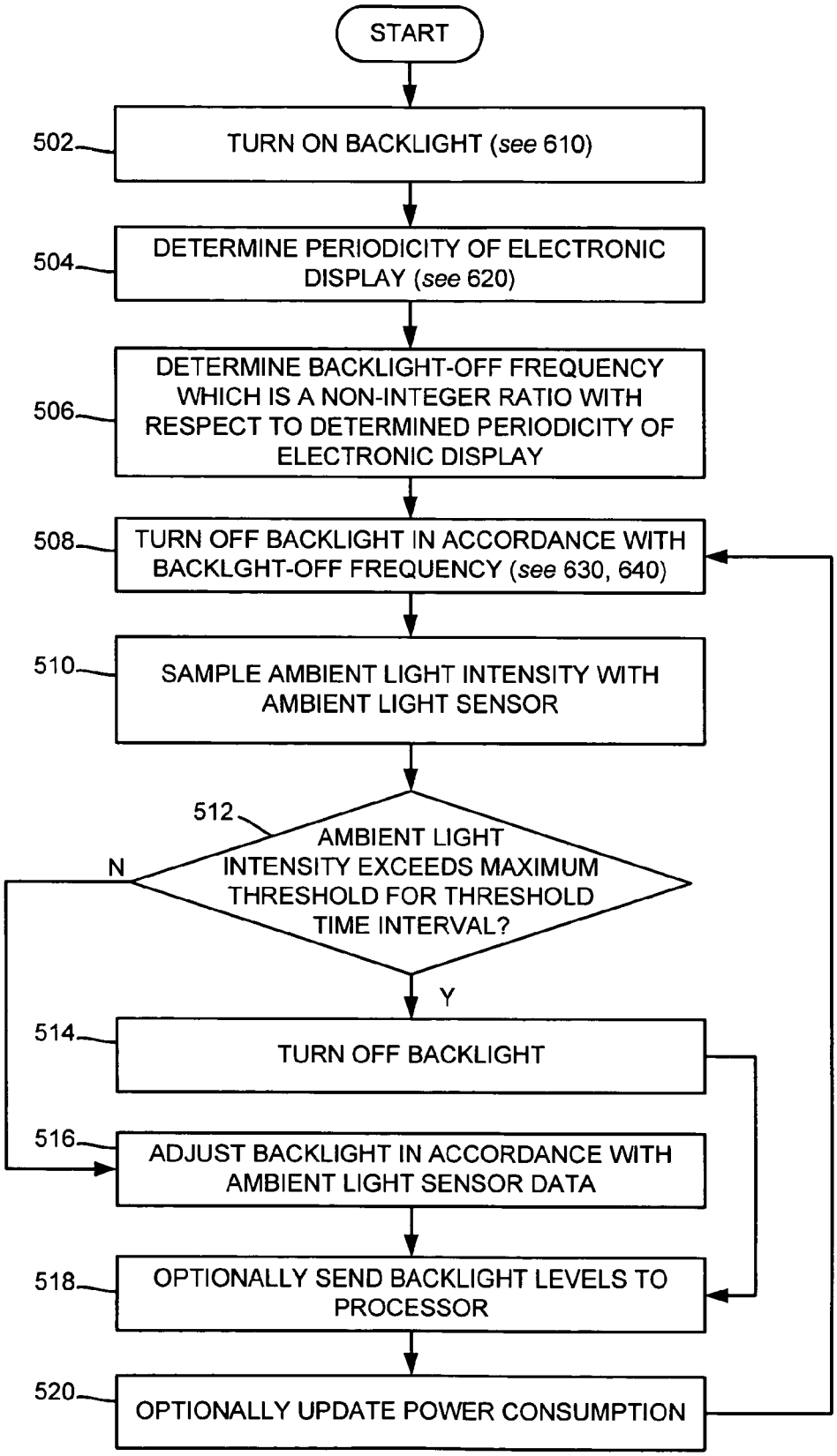
FIG. 5 is an illustrative flowchart of a method of dynamically controlling a backlight in accordance with embodiments of the present invention.
Figure 6:
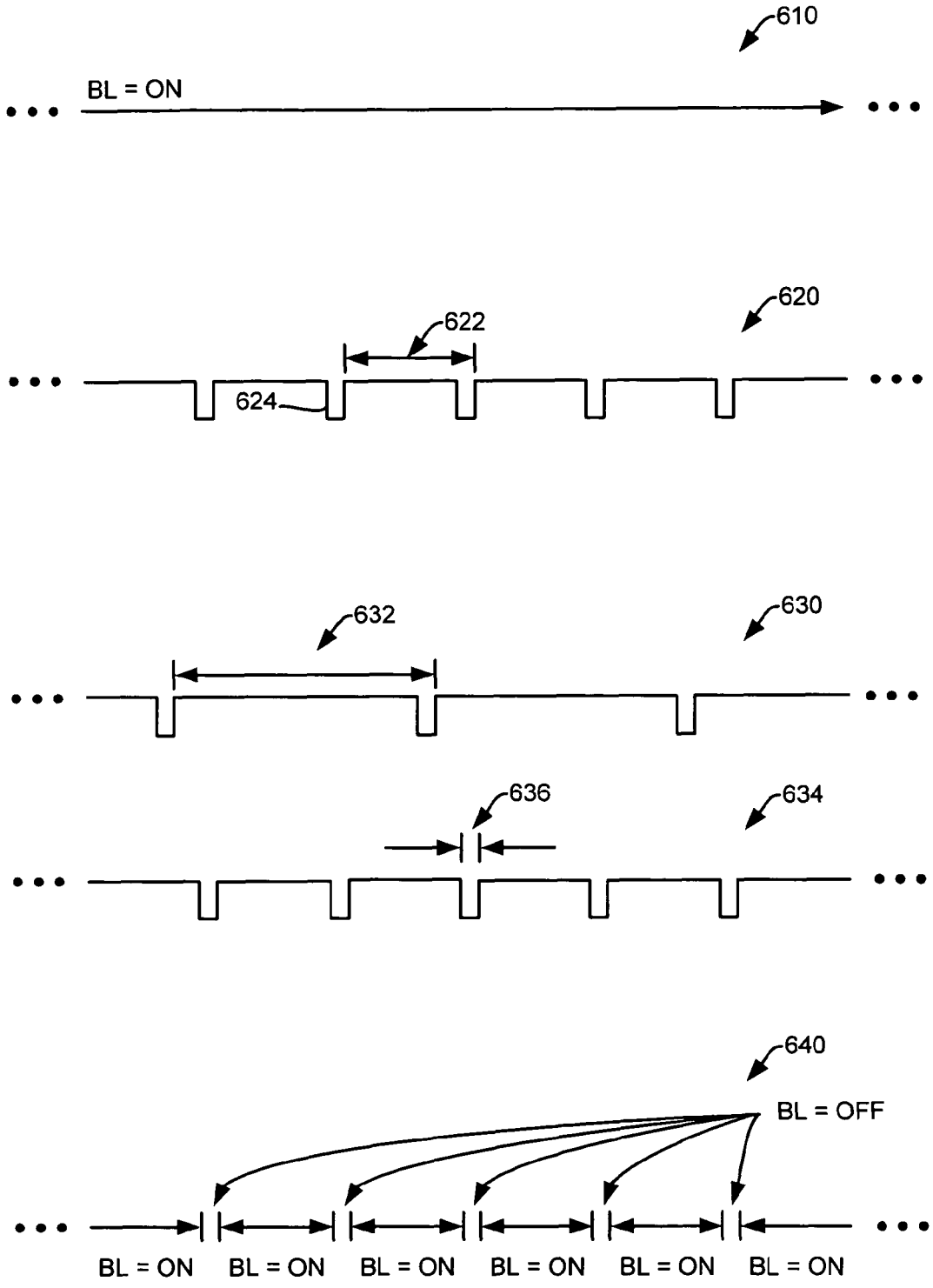
FIG. 6 is an illustrative representation of periodicity of an electronic display in accordance with embodiments of the present invention.

Turning to FIGS. 5 and 6, FIG. 5 is an illustrative flowchart of a method of dynamically controlling a backlight in accordance with embodiments of the present invention, and FIG. 6 is an illustrative representation of periodicity of an electronic display in accordance with embodiments of the present invention. At a first step 502, backlight is turned on. That is, backlight condition is set to ON. Graph 610 of FIG. 6 represents a backlight=ON condition. At a next step 504, periodicity of the electronic display is determined. Periodicity, for the purposes of this disclosure, relates to a refresh rate of an electronic display. Periodicity is further illustrated by graph 620 of FIG. 6. As may be appreciated by one skilled in the art, a typical LCD screen refreshes at some temporal interval. The beginning of that an example temporal interval is indicated by first line marker 624 (FIG. 6). One full display refresh, or frame is indicated by 622. The method, at a step 504, determines the frame by finding the time between first line markers and subsequently determines the periodicity. Thus, for example, if the method determines that a frame is 16.67 ms, then the periodicity is calculated as 60 Hz (i.e. 1000/16.67 ms).

At a next step 506, a backlight-off frequency is determined. A backlight-off frequency is a non-integer ratio with respect to the determined periodicity of the electronic display. Thus, in the example presented above, a non-integer ratio of 60 Hz would include, for example, 7, 8, and 9. Other non-integer ratios may be utilized without limitation and without departing from the present invention. At least one reason for selecting a non-integer ratio is to avoid flicker in the electronic display. At a next step 508, backlight is turned off at the backlight-off frequency as represented by graphs 630, 634, and 640 of FIG. Graph 630 represents a frame refresh rate with respect to a backlight-off interval as seen in graph 634. Graph 630 is a magnified view of graph 620 and is presented for clarity's sake only. Interval 636 represents a backlight-off interval that corresponds to a fraction of a frame such as frame 632. As may be seen in graph 640, backlight condition is set to OFF for that interval. In some embodiments a backlight-off frequency may enabled to occur more than once for every full display refresh or frame. In other embodiments a backlight-off frequency may enabled to occur less than once for every full display refresh or frame. As may be appreciated, the illustrated graphs are not drawn to scale and are presented to further clarify embodiments described herein.

At a next step 510, ambient light intensity is sampled with an ambient light sensor. Light sensing is generally well-known in the art and may be accomplished in any number of manners without departing from the present invention. With the backlight set to OFF condition, stray emissions, as noted above for FIGS. 2 and 3, may be reduced or altogether eliminated thus resulting in a more accurate sensor reading. The method then determines whether a sampled ambient light intensity exceeds a maximum threshold for a threshold time interval at a step 512. In situations where an electronic device is carried into direct sunlight, for example, the use of backlight is superfluous. That is, backlighting under very bright conditions does not improve viewing for a user. Thus, when the ambient light intensity exceeds a maximum threshold over a threshold time interval at a step 512, the method proceeds to a step 514 to set backlight condition to OFF, which may, in some examples, improve power consumption profiles. The method then proceeds to a step 518. If ambient light intensity does not exceed a maximum threshold over a threshold interval at a step 512, the method proceeds to a step 516 to adjust backlight level. As may be appreciated, adjusting a light level is well-known in the art. Thus, any method of adjusting backlight level with respect to ambient light sensor data may be utilized without departing from the present invention. The method then proceeds to a step 518.

Returning to FIG. 5, in some embodiments, optional steps 518 and 520 may be utilized. At a step 518, the method may send determined backlight levels to a processor. Backlight level data may be useful for any number of calculations including, for example, power consumption calculations. As may be appreciated, battery life in small portable devices is necessarily limited. Thus, ambient light sensor data may be utilized to determine backlight levels, which in turn, directly correspond to power consumption. Thus, using backlight levels, the method updates power consumption at a step 520. In some embodiments, ambient light sensor data may be sent to a processor to derive power consumption levels. In some embodiments, power consumption may be graphically displayed on an electronic display to provide direct visual feedback to a user. The method then returns to a step 508 to turn off the backlight in accordance with the backlight-off frequency.

Figure 4:
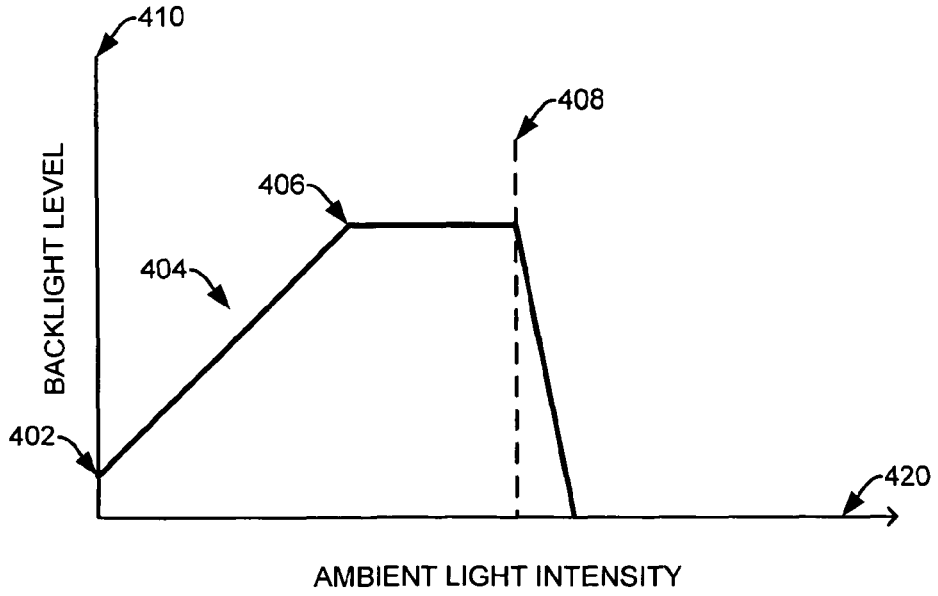
FIG. 4 is a graphical representation of a backlight control curve graph in accordance with embodiments of the present invention.

FIG. 4 is a graphical representation of a backlight control curve graph in accordance with embodiments of the present invention. As noted above, backlight control may be utilized with and LCD electronic display. However, embodiments provided herein may be equally applied to LED and OLED's without departing from the present invention. As illustrated, a control curve is graphed with respect to backlight level 410 and ambient light intensity 420. In this example, a minimum backlight start level 402 may be utilized at a low ambient light intensity. Curve portion 404 represents a dynamic increase in backlight level over a range of ambient light intensities using methods described herein. Point 406 represents a maximum backlight level available for a particular ambient light level. Point 408 represents a point at which ambient light intensity is so high enough that the electronic display no longer benefits from backlight, at which point backlight level is reduced to zero (i.e. backlight condition is set to OFF). As may be appreciated, dynamic changes in backlighting levels may provide fine control of backlighting to closely match an ambient light condition. This fine level of control may, in some examples, greatly enhance a user's viewing experience. It may be appreciated that the curve, as illustrated, is for clarity's sake only and provides an approximation of one embodiment. No additional limitations are intended or expressed in the embodiment provided.

Figure 7:
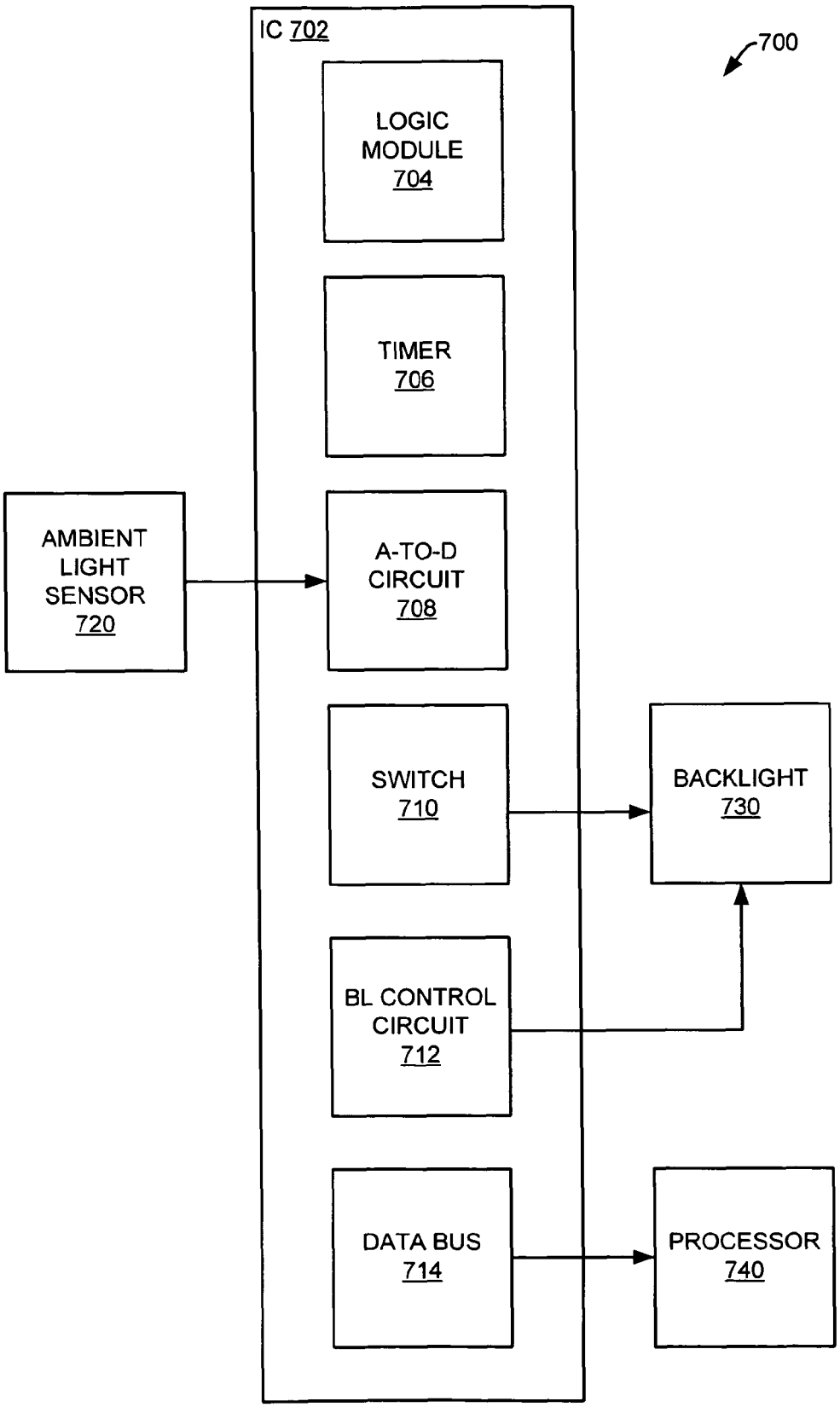
FIG. 7 is a graphical representation of a system for dynamically controlling a backlight in accordance with embodiments of the present invention.

FIG. 7 is a graphical representation of a system 700 for dynamically controlling a backlight in accordance with embodiments of the present invention. As may be appreciated, embodiments described may be enabled in a circuit, a software method, and combinations of both circuits and software without departing from the present invention. Thus, a system 700 dynamically controlling a backlight is illustrated utilizing integrated circuit (IC) 702. In system 700, ambient light sensor 702 may be provided for sensing ambient light intensity; backlight 730 may be provided for illuminating an electronic display; and processor 740 may be optionally provided for calculating power consumption levels, for example. These three components may be utilized in combination with IC 702 to control backlighting in various ambient lighting conditions.

IC 702 may provide circuitry for any number of functions. Thus, switch 710 may be provided for setting backlight condition to ON or OFF. As noted above, methods described may set backlight 730 condition ON or OFF over a backlight-off frequency in order to avoid receiving stray emissions from backlight 730 at ambient light sensor 720. Any manner of switching may be utilized without departing from the present invention. Logic module 704 may be provided for determining backlight levels in response to ambient light intensity. As may be appreciated, logic may be provided to accomplish methods described for FIG. 5 above. Logic functions include, for example: logic for determining periodicity of an electronic display: logic for determining backlight-off frequencies at a non-integer ration with respect to the periodicity of an electronic display; and logic for controlling switch 714. Backlight control circuit 712 may be provided for adjusting backlight 730 in response to backlight levels determined by logic module 704. An analog-to-digital circuit 708 may be configured to convert ambient light intensity into ambient light intensity data whereby ambient light intensity data may be utilized for calculations by logic module 704 and processor 740. A data bus 714 may be configured to send backlight levels to processor 740. In some embodiments, data bus 714 may be configured to send ambient light intensity data. In some embodiments, processor 740 may include logic for determining power consumption levels based on backlight levels. In other embodiments, power consumption levels may be graphically displayed on an electronic display. Further, a timer 706 may be utilized to provide a timing element for logic module 704.

While this invention has been described in terms of several embodiments, there are alterations, permutations, and equivalents, which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. An electronic device, comprising:

an outer housing;

a display processor disposed within said outer housing;

a visual display coupled to said display processor and adapted to provide a visual display output from the display processor to a user of the electronic device; and a backlight control system including a backlight adapted to illuminate the visual display, a switch configured to set the backlight to an ON or OFF state according to a backlight-off frequency, wherein the backlight-off frequency is determined such that flicker in the visual display is avoided, and an ambient light sensor adapted to sense an ambient light intensity when the backlight is temporarily off during the backlight-ON state, and to provide an indication thereof to a backlight control processor when the ambient light intensity is greater than a threshold value.

2. The electronic device of claim 1, wherein the backlight-off frequency results in a recurring backlight-off interval, and wherein the backlight-off interval corresponds to a fraction of the time for a frame refresh of the visual display.

3. The electronic device of claim 1, further comprising:

an analog-to-digital circuit adapted to convert the ambient light intensity into ambient light intensity data; and a data bus configured to send the ambient light intensity data to a backlight control processor.

4. The electronic device of claim 1, wherein the display processor is also the backlight control processor.

5. The electronic device of claim 1, wherein said electronic device is a portable electronic device.

6. The electronic device of claim 1, wherein the backlight control system further includes:

at least one of a set of circuitry and a software module adapted to determine a periodicity of the visual display, at least one of a set of circuitry and a software module for determining the backlight-off frequency based on the periodicity of the visual display such that the backlight-off frequency is at a non-integer ratio with respect to the periodicity of the visual display, and at least one of a set of circuitry and a software module for controlling the switch in accordance with the backlight-off frequency.

7. The electronic device of claim 1, wherein the backlight control processor is adapted to respond to the indication by reducing power consumption of the portable device by adjusting the level of the backlight.

8. The electronic device of claim 7, wherein the backlight control processor causes the backlight to turn to a backlight-OFF state when the threshold value is sufficiently high.

9. A power control system in a battery powered portable device having an electronic display, comprising:

a processor associated with an electronic display;

a backlight that illuminates the electronic display coupled to the processor, wherein the backlight is adapted to switch on and off automatically according to a backlight-off frequency while the backlight is in a backlight-ON state; and an ambient light sensor adapted to detect an ambient light intensity while the backlight is temporarily off during the backlight-ON state and provide an indication thereof to the processor when the ambient light intensity is greater than a first threshold value, wherein the processor is adapted to respond to the indication by reducing power consumption of the portable device by adjusting the level of the backlight.

10. The power control system of claim 9, wherein the processor causes the backlight to turn to a backlight-OFF state when the first threshold value is sufficiently high.

11. The power control system of claim 9, further comprising:

at least one of a set of circuitry and a software module adapted to determine whether the ambient light intensity exceeds a maximum threshold value for a threshold time interval; and at least one of a set of circuitry and a software module adapted to turn off the backlight when the ambient light intensity exceeds the maximum threshold value over the threshold time interval.

12. The power control system of claim 9, wherein the backlight-off frequency results in a recurring backlight-off interval, and wherein the backlight-off interval corresponds to a fraction of the time for a frame refresh of the electronic display.

13. The power control system of claim 9, further including:

at least one of a set of circuitry and a software module adapted to determine a periodicity of the electronic display; and at least one of a set of circuitry and a software module for determining the backlight-off frequency based on the periodicity of the electronic display such that the backlight-off frequency is at a non-integer ratio with respect to the periodicity of the electronic display.

14. A method of conserving power in an electronic device, comprising:

determining the periodicity of an electronic display on an electronic device;

setting a backlight-off frequency of a backlight adapted to illuminate the electronic display, wherein the backlight-off frequency is set according to the periodicity such that flicker in the electronic display is avoided;

sensing an ambient light intensity associated with the electronic display when the backlight is off;

providing an indication to a backlight control processor when the ambient light intensity is greater than a first threshold value; and reducing power consumption of the electronic device by lowering the level of the backlight when the backlight control processor receives said indication.

15. The method of claim 14, wherein the backlight-off frequency results in a recurring backlight-off interval, and wherein the backlight-off interval corresponds to a fraction of the time for a frame refresh of the electronic display.

16. The method of claim 14, wherein said reducing step includes setting the backlight to an OFF state when the first threshold value is sufficiently high.

17. The method of claim 14, wherein the backlight-off frequency is set such that the backlight-off frequency is at a non-integer ratio with respect to the periodicity of the visual display.

18. The method of claim 14, furthering including the steps of:

determining whether the ambient light intensity exceeds a maximum threshold value for a threshold time interval; and turning off the backlight when the ambient light intensity exceeds the maximum threshold value over the threshold time interval.

19. The method of claim 14, wherein said electronic device is a portable electronic device.

* * * * *